US010322327B2

(12) United States Patent
Shaw

(10) Patent No.: US 10,322,327 B2
(45) Date of Patent: Jun. 18, 2019

(54) ORBITING BOB TOY WITH BOBS HAVING PELLET-FILLED EQUATORIAL BAGS

(71) Applicant: Laurence J. Shaw, San Francisco, CA (US)

(72) Inventor: Laurence J. Shaw, San Francisco, CA (US)

( * ) Notice: Subject to any disclaimer, the term of this patent is extended or adjusted under 35 U.S.C. 154(b) by 0 days.

(21) Appl. No.: 15/915,062

(22) Filed: Mar. 7, 2018

(65) Prior Publication Data

US 2018/0326275 A1 Nov. 15, 2018

Related U.S. Application Data

(60) Provisional application No. 62/469,510, filed on Mar. 9, 2017.

(51) Int. Cl.

| | |
|---|---|
| ***A63B 67/10*** | (2006.01) |
| ***A63B 67/12*** | (2006.01) |
| ***A63F 7/24*** | (2006.01) |
| ***A63F 7/28*** | (2006.01) |
| ***A63F 7/40*** | (2006.01) |
| ***A63B 37/02*** | (2006.01) |
| ***A63B 37/12*** | (2006.01) |
| ***A63B 43/00*** | (2006.01) |
| *A63H 33/18* | (2006.01) |
| *A63B 69/00* | (2006.01) |

(52) U.S. Cl.

CPC ..... *A63B 67/10* (2013.01); *A63B 37/02* (2013.01); *A63B 37/12* (2013.01); *A63B 43/00* (2013.01); *A63B 67/12* (2013.01); *A63F 7/24* (2013.01); *A63F 7/28* (2013.01); *A63F 7/40* (2013.01); *A63B 43/007* (2013.01); *A63B 69/0079* (2013.01); *A63H 33/18* (2013.01)

(58) Field of Classification Search

CPC ..... A63B 67/10; A63B 67/12; A63B 37/02; A63B 37/12; A63B 43/00; A63B 43/007; A63B 69/0079; A63F 7/24; A63F 7/28; A63F 7/40; A63H 33/18

USPC ..... 446/242, 247, 489, 490

See application file for complete search history.

(56) References Cited

U.S. PATENT DOCUMENTS

2004/0198174 A1* 10/2004 Shaw ..... A63B 43/007 446/490
2005/0048872 A1* 3/2005 Shaw ..... A63B 43/007 446/490
2016/0332051 A1* 11/2016 Shaw ..... A63B 67/10

* cited by examiner

*Primary Examiner* — Vishu K Mendiratta
(74) *Attorney, Agent, or Firm* — Laurence J. Shaw; Integral Patent

(57) ABSTRACT

A toy having three bobs on a string where the middle bob slides. A low moment of inertia of the middle bob is desirable because it minimizes tangling of the string about the middle bob and produces smooth, tactile-appealing orbits. Each bob has a pair of mated throughbore pieces sandwiching a central metal weight and an equatorial bag stuffed with low-density pellets. Concave sections (in profile on a plane along the polar axis) of the throughbore occupy a substantial portion of the length of the throughbore to take best advantage of the torques produced by the string by focusing the tension of the string at the mouths of the throughbore. The concave sections also reduce the volume occupied by the bag, thereby reducing moment of inertia. Additionally, hollows in the concave regions of the throughbore pieces further reduce the moment of inertia.

9 Claims, 6 Drawing Sheets

ORBITING BOB TOY WITH BOBS HAVING PELLET-FILLED EQUATORIAL BAGS

RELATED APPLICATIONS

The present application is based on and claims priority to provisional patent application Ser. No. 62/469,510 filed Mar. 9, 2017 by the present inventor for "Orbiting bob toy with pellet-filled equatorial bag."

FIELD OF THE INVENTION

The present invention is related to skill toys, and more particularly to swinging/orbiting bob toys where a bob with a low moment of inertia and/or a bob which effectively utilizes string torques is beneficial.

BACKGROUND OF THE INVENTION

As is shown in FIGS. 1A through 1D, the present invention relates to a toy (5) having three bobs (10), (11) and (12) on a string (20), with the end bobs (10) and (12) constrained at the ends (21) and (22) of the string (20), and the middle bob (11) having a throughbore (30) through which the string (20) passes, thereby allowing the middle bob (11) to slide along the string (20). The toy (5) may be operated by holding an end bob (12) and oscillating the hand (41) to produce, for instance, vertical orbits of the bobs (10) and (11), as is shown in the time sequence of FIGS. 1A through 1D. In addition, stable horizontal orbits and stable figure-eight type orbits, or irregular orbits, can be generated by holding an end bob (12) and oscillating the hand. Furthermore, given the combinatorics of possible orbital directions and holds and transitions between holds with one or both hands of one or more of the bobs (10), (11) and (12) and/or one or more sections of the string (20), a very large number of tricks and maneuvers may be performed.

As discussed in U.S. Pat. Nos. RE34208, 6,629,873 and 6,896,578 (which are incorporated herein by reference), a crucial aspect of the design of orbiting bob toys (5) where the middle bob (11) acts as a sliding focus/pivot point to the orbiting of an outer bob (12) is that the middle bob (11) has a low moment of inertia about axes perpendicular to the bore axis. A low moment of inertia insures that the middle bob (11) can rotate rapidly in response to torques on the middle bob (11) produced by the tension of the string (20) during the "string pass" of vertical orbits, i.e., the period where the orbiting end bob (12) is at the top of its orbit and passes by the string (20) between the held end bob (10) and the middle ball (11)) so that play feels smooth and the string (20) does not snag around the middle bob (11). For play to feel smooth, the middle bob (11) must complete a 180° rotation during the string pass in roughly $1/20^{th}$ of a second.

A measure of the goodness of operation of the design of the middle bob (11) is a dimensionless goodness-of-operation ratio Φ given by $$\Phi=(mh^2/I)^{1/2} \tag{1.1}$$

where m is the mass of a bob (10), (11) or (12), h is the height of the throughbore through the middle bob (11), and I is the moment of inertia of the middle bob (11) about an axis of rotation in the equatorial plane of the middle bob (11). The moment of inertia I is given by $$I=\int\rho r^2 d\tau, \tag{1.2}$$

where ρ is density, r is distance from the axis of rotation, dτ is an infinitesimal volume element, and the integration is performed over volume. When the middle bob (11) has a large goodness-of-operation ratio Φ, not only will snagging of the string (20) about the middle ball (11) be avoided, the orbits will have an attractive smooth, relaxing feel.

It should be noted that the dependence of moment of inertia I on the second power of the distance r results in a dramatic dependence on dimensions. The sensitivity to dimensions produced by the $r^2$ weighting is exemplified by the fact that for a sphere of homogeneous mass of radius R, the inner half of a sphere (i.e., the region within a radius of R/2) contributes only about 3% to the total moment of inertia, while the outer half contributes about 97% to the total moment of inertia.

Maximization of the goodness-of-play ratio Φ has previously been accomplished in several ways. As discussed in U.S. Pat. No. RE34,208 and shown in FIG. 4 of that patent, one maximization method is to locate a metal weight in the central region of the bob, and provide an outside mantle of a low-density material. However, with this design the size of bobs is limited by material constraints. In versions produced by New Toy Classics of San Francisco, Calif., Tangent Toy Company of Sausalito, Calif., and Active People of Binningen, Switzerland, the central weight was made of the highest density, non-toxic, non-radioactive, non-precious metals, i.e., brass and steel, and the outer mantle was made of one of the most durable, low-density foams, i.e., integral-skin polyurethane foam. Brass has a specific gravity of roughly 8.5, steel has a specific gravity of roughly 7.9, and integral-skin polyurethane foam has a specific gravity of roughly 0.25. Due to the practical upper and lower limits in specific gravity of the components, the bobs (10), (11) and (12) have been limited to a diameter of less than 3.5 cm. In particular, each bob (10), (11) and (12) had a cylindrical brass weight with a height of 1.27 cm, width of 1.27 cm, and throughbore width of 0.32 cm, a mass $m_w$ of 12.5 g and a moment of inertia $I_w$ of 2.98 g*cm$^2$. And each bob (10), (11) and (12) had a substantially spherical polyurethane foam outer mantle with a diameter of 3.3 cm and height of 2.7 cm, throughbore sections which are substantially conical, a mass $m_m$ of 3.8 g, and a moment of inertia $I_w$ of 4.15 g*cm$^2$. The goodness-of-operation ratio Φ is therefore $[(m_w+m_m)\ h^2/(I_w+I_m)]^{1/2}=[(12.5+3.8)*2.7^2/(2.98+4.15)]^{1/2}\cong 4.1$. It should further be noted that a sufficiently soft foam is difficult to achieve with integral-skin polyurethane foam. Furthermore, the process of producing integral-skin polyurethane foam is very sensitive to temperature and humidity, and there is often considerable variability in softness in the course of even a single production run.

Another approach has been to produce bobs with liquid-filled bladders. As described in U.S. Pat. No. 6,896,578, fluid flows in the bladder produce a lowered dynamic moment of inertia. The liquid used is predominantly water since, of economical, non-toxic liquids, water has a particularly low viscosity. However, the size of the bobs (10), (11) and (12) has been limited to a diameter of less than 3.6 cm due to the specific gravity of water of 1 g/cc contributing significantly to weight as size increases.

It should be noted that the diameters of the above-described orbiting bob toys are substantially smaller than the diameter of bobs, chassis, or bodies of other common skill toys. For instance, the balls of Kendama toys, the bobs of poi toys, and the bodies of yo-yos generally have a diameter of about 5 cm or greater. These larger diameters provide the important advantages of allowing the bobs/bodies to be more easily grasped and more easily visible to the player and any audience.

Furthermore, with regards to the toys taught in U.S. Pat. Nos. RE34208, 6,629,873 and 6,896,578, in cross-section on a plane along the bore axis (i.e., in "profile") the throughbore has sections which in profile are substantially linear or convex. The advantage of linear or convex sections is that they can create contact, and therefore distribute pressure, between the string and the bore section along an extended length of the string and the bore section. This is particularly advantageous when the linear or convex section is made of a compressible material, such as foam, since the degree to which the string digs into the bore material is reduced, thereby reducing sliding friction. It should also be noted that because the string may slide over the bore transversely as well as longitudinally, a surface of cylindrical symmetry is required to avoid the string catching on protrusions in any region where the string makes contact with the throughbore.

Objects of the present invention for an orbiting bob toy include:

providing a middle bob with a low moment of inertia, increasing the size of the bobs, particularly to be large enough to be easily visible and graspable, providing a throughbore contour which reduces moment of inertia and takes advantage of forces produced by the string to increase torques, providing a throughbore surface with non-cylindrical symmetry, particularly for the purpose of reducing moment of inertia, maximizing a goodness-of-operation ratio, providing bobs that are soft so impacts of bobs with the player cause minimal discomfort, providing bobs which have a mantle which includes low-density granules, and providing an orbiting bob toy having a wide variety of surface designs.

SUMMARY OF THE INVENTION

The present invention is directed to an orbiting bob toy having a string, an end bob, and a sliding bob. The sliding bob has a throughbore component providing a throughbore having a first mouth and a second mouth. The string passes through the throughbore and the sliding bob is slidable along the string. The end bob is constrained on the string between the sliding bob and an end of the string. The sliding bob has a weight encircling a central portion of the throughbore component, and a bag stuffed with pellets encircling the throughbore component and the weight. The specific gravity of the pellets is less than that of the throughbore component, which is in turn less than that of the weight.

The present invention is also directed to an orbiting bob toy having a string, an end bob, and a sliding bob. The sliding bob has a throughbore component providing a throughbore having a first mouth and a second mouth. The string passes through the throughbore and the sliding bob is slidable along the string. The end bob is constrained on the string between the sliding bob and an end of the string. The sliding bob has a weight encircling a central portion of the throughbore component, and a bag stuffed with pellets encircling the throughbore component and the weight. An intermediate portion of the throughbore component on each side of the equatorial plane of the sliding bob, in cross-section on a plane along the polar axis of the sliding bob, has a concave contour.

BRIEF DESCRIPTION OF THE DRAWINGS

The accompanying figures illustrate embodiments of the invention and, together with the text, explain the principles of the invention.

DETAILED DESCRIPTION OF THE PREFERRED EMBODIMENTS

Figure 1A:
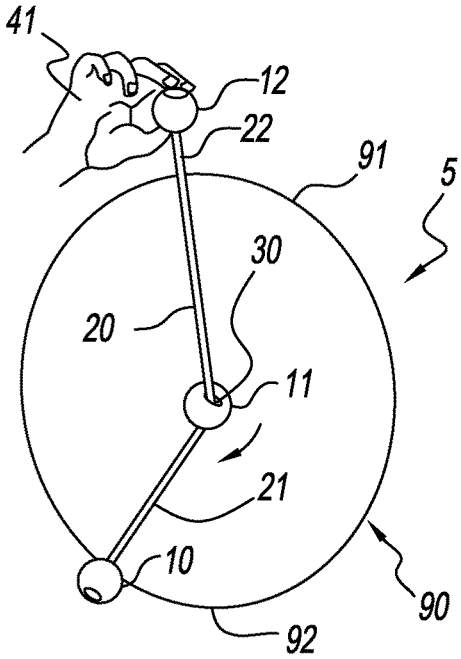
FIG. 1A (Prior Art)
FIGS. 1A through 1D show operation of an orbiting bob toy in the course of vertical orbits.
Figure 1B:
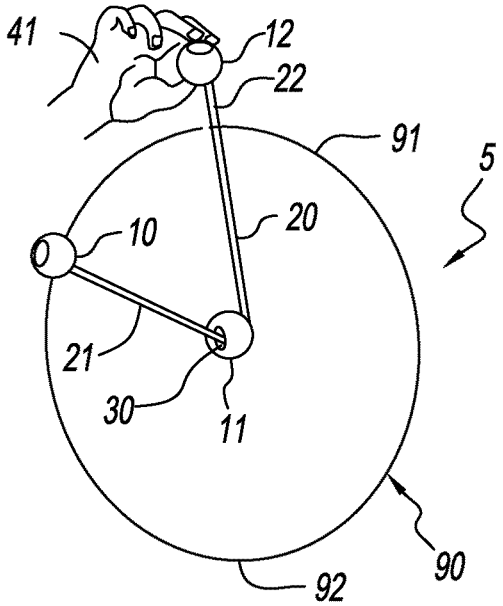
FIG. 1B (Prior Art)
Figure 1C:
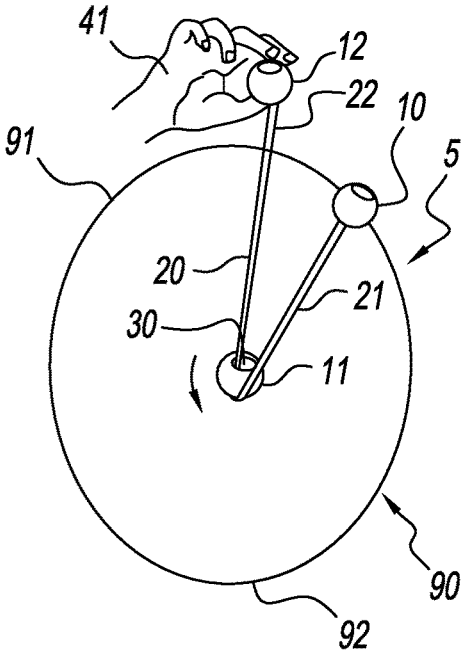
FIG. 1C (Prior Art)
Figure 1D:
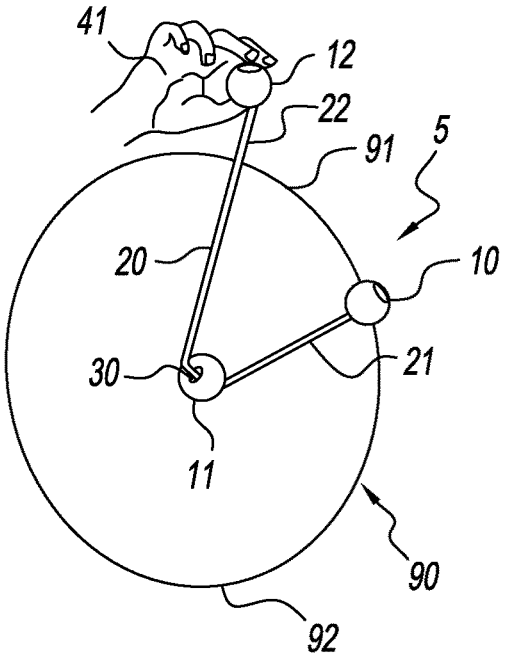
FIG. 1D (Prior Art)
Figure 2A:
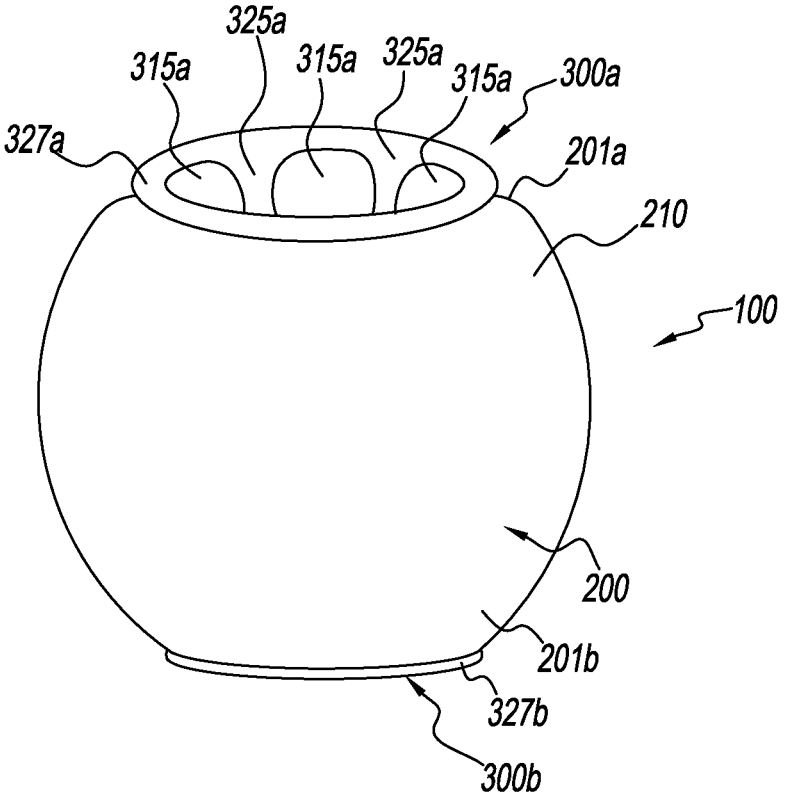
FIG. 2A shows a perspective view of a bob of the toy of the present invention.
Figure 2B:
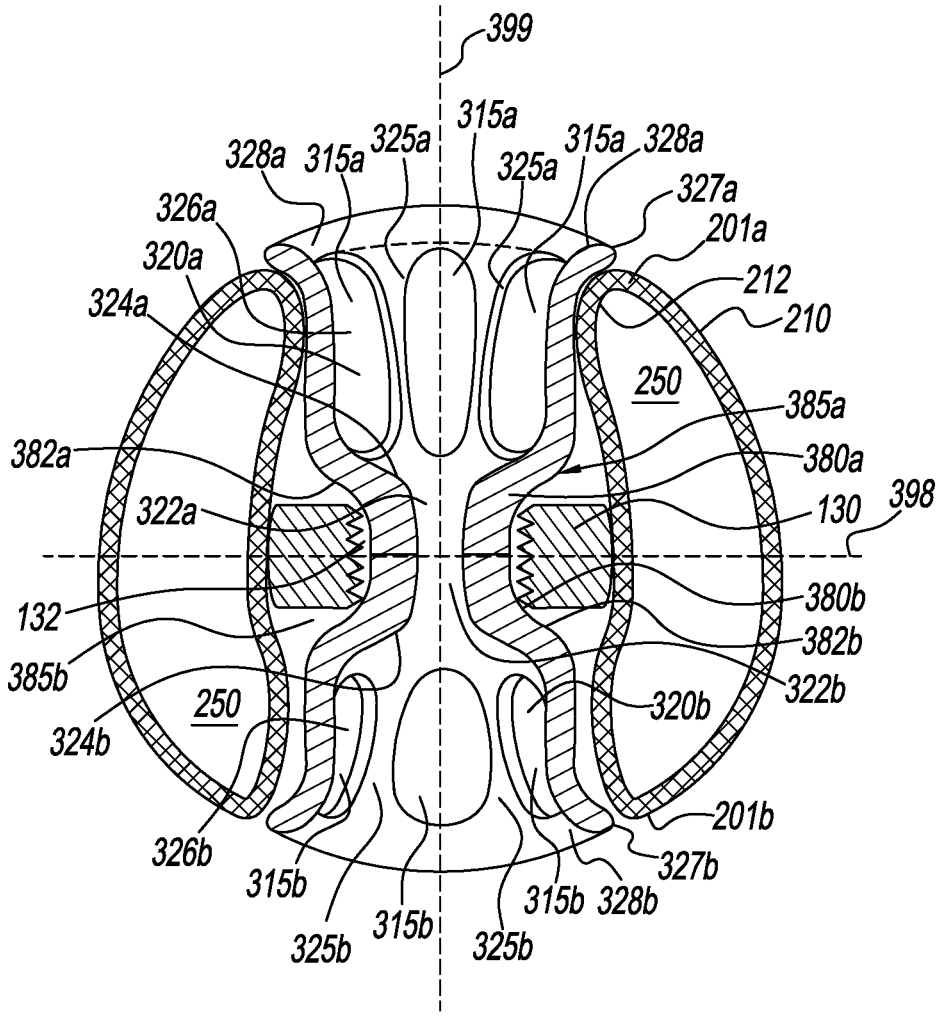
FIG. 2B shows a cross-sectional view of the bob of FIG. 2A where the cross-section passes through the spokes of a throughbore piece.
Figure 2C:
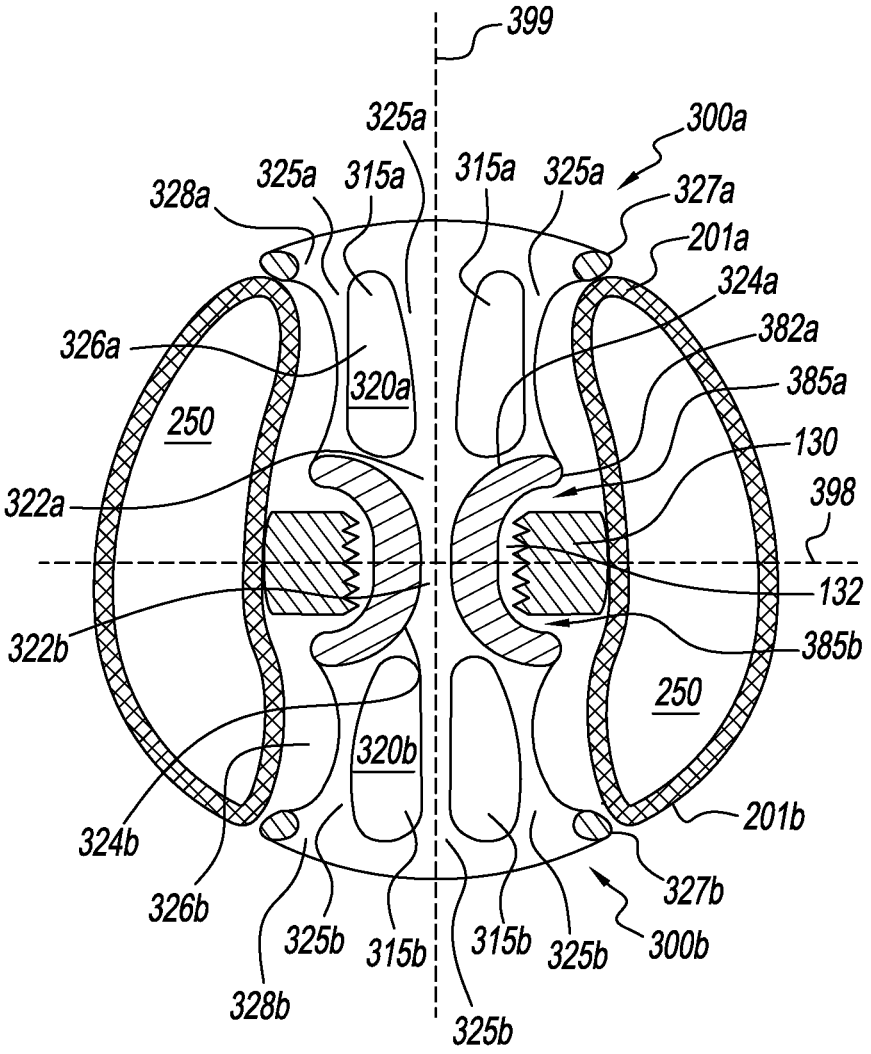
FIG. 2C shows a cross-sectional view of the bob of FIG. 2A where the cross-section passes through the hollows of a throughbore piece.

As shown in the perspective view of FIG. 2A and the cross-sectional views of FIGS. 2B and 2C, each bob (100) of the toy (10) of the present invention has an equatorial bag (200) stuffed with pellets (250). The equatorial bag (200) encircles a central weight (130), and upper and lower throughbore pieces (300*a*) and (300*b*) sandwich the central weight (130) and the bag (200). (The throughbore pieces (300*a*) and (300*b*) will herein be referred to generically or collectively with reference numeral 300, and a similar numbering system will be applied to elements of the throughbore pieces (300).)

Figure 3A:
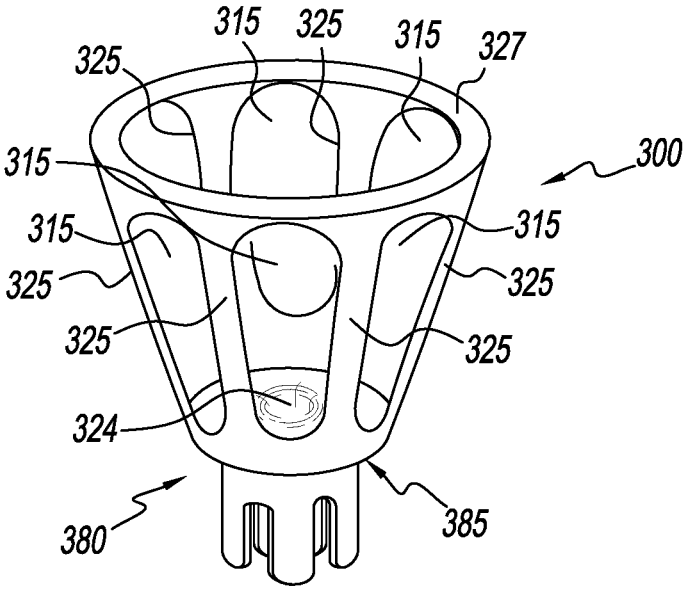
FIG. 3A shows a perspective view from above of the upper throughbore piece of the bob of FIG. 2A.
Figure 3B:
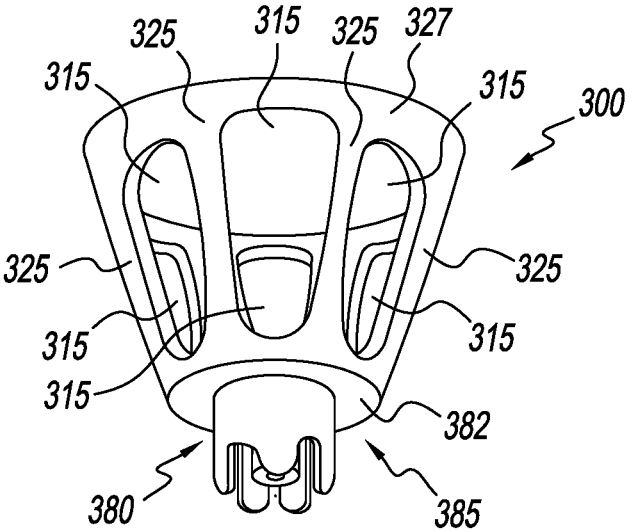
FIG. 3B shows a perspective view from below of the upper throughbore piece of the bob of FIG. 2A.

FIGS. 3A and 3B show perspective views of a throughbore piece (300) from above and below, respectively. Each throughbore piece (300) has a rim (327), a base (385), and spokes (325) connecting the rim (327) to the base (385). The rims (327) are at the mouths of the throughbore (320) which is produced by the inner surfaces of the throughbore pieces (300*a*) and (300*b*). Between the spokes (325) are hollows (315). The throughbore (320) has a base portion (322) which is the narrowest portion of the throughbore (320), a transition portion (324) which is convex, a intermediate portion (326) which is concave, and a rim portion (328) which is convex. Preferably, the concave intermediate portion (326) is longer (both along the bore axis and in length along the surface) than the transition portion (324) and the rim portion (328). The shape of the throughbore (320) produced by the mated upper and lower throughbore pieces (300*a*) and (300*b*) is therefore such that the string (50) contacts the base portion (322), the transition portions (324) and the rim portions (328) but, when under tension, the string (50) does not contact the intermediate portions (326).

Figure 4:
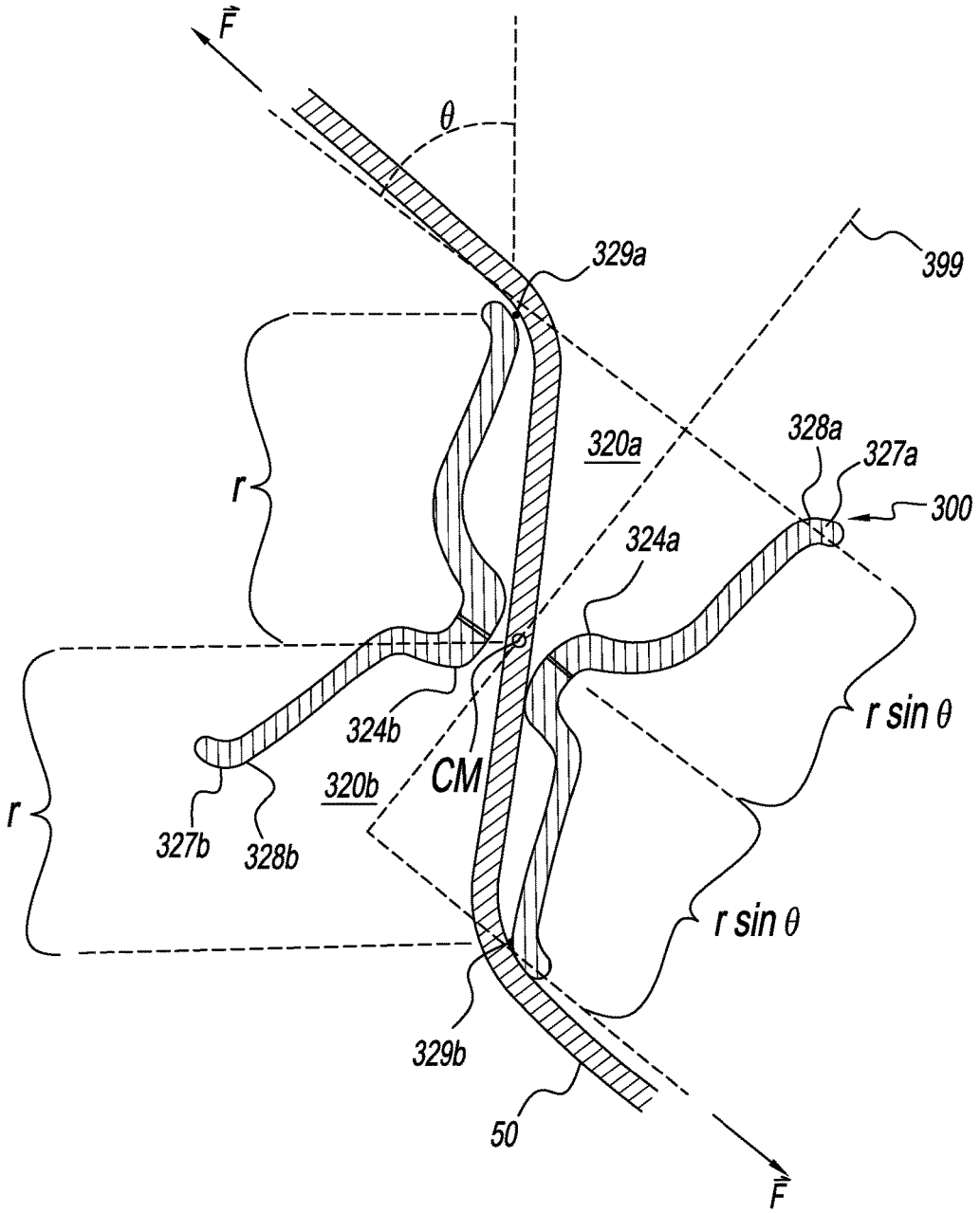
FIG. 4 shows how a throughbore component with convex portions concentrates the forces applied by the string at the mouths of the throughbore.

As noted above, previous versions of the orbiting bob toy have had throughbores profiles with sections which are predominantly linear or convex so as to distribute the pressure of the string (20) over an extended length of the throughbore (320), thereby avoiding concentrating the pressure of the string (20) on particular regions. This is particularly advantageous when the throughbore (320) is made of a compressible material and deformation of the throughbore (320) by the string (20) produces increased sliding friction. And even with non-compressible throughbore materials, because the string (20) is compressible there may be a decrease in sliding friction with an increase in contact area. However, according to the present invention the advantage of decreased friction is ceded by including concave intermediate sections (326) in order to incorporate a high-density material around the center of the throughbore piece (300) to lower the moment of inertia of the bob and also maximize useful torques applied by the string (50). In particular, as is shown in FIG. 4 the throughbore (320) is contoured so that the points of contact (329) of the string (50) with the throughbore (320) is focused/concentrated at the rims (327). This is advantageous because torque Γ is given by the vector cross product of force F and the moment arm r from the center of mass (CM) to the point of contact (329), i.e., $\Gamma = F\ r \sin\theta$. By concentrating the force F applied by the string (50) is at contact points/regions (329) at the mouths (327*a*) of the throughbore (320)—rather than along the interior portions of the throughbore (320)—the product ($r \sin\theta$) and hence the torque Γ is maximized. Furthermore, the concavity of the intermediate sections (326) corresponds to convexity on the outside of the throughbore pieces (320). This results in the bag (200) occupying less volume, hence reducing the moment of inertia of the bag (200). Preferably, each concave intermediate portion (326) has a length along the polar axis (399) which is greater than one eighth, more preferably one fifth, more preferably one quarter, still more preferably one third the height of the throughbore (300).

Furthermore, the lack of contact of the string (50) when under tension with the intermediate throughbore portions (326*a*) and (326*b*) is taken advantage of by the inclusion of the hollows (315) (and therefore spokes (325)) in this region of the throughbore piece (300). The hollows (315) lower the contribution of the throughbore pieces (300) to the total moment of inertia. Hollows cannot be incorporated into the throughbore piece (300) in regions where the string (50) makes contact when under tension, because the string (50) would then catch on edges of the hollows during orbits or maneuvers where the string (50) slides (transversely) around the throughbore (320). The throughbore pieces (300) are made of a plastic having a density of about 1.2 g/cc. This specific gravity is larger than the specific gravity of the pellets (see below) or the fabric of the equatorial bag (200), so lowering the moment of inertia of the throughbore piece (300) by incorporating hollows (315) significantly decreases the total moment of inertia of the bob (100).

The base (385) of each throughbore piece (300) has an outer-surface recess (380) with a height along the bore axis (399) slightly larger than half the height of the central weight (130), an outer diameter slightly less than the diameter of the throughbore (132) of the weight (130), and a shoulder (382) with an outer diameter somewhat greater than the diameter of the throughbore (132) of the central weight (130). Hence, when of two throughbore pieces (300) are attached (by gluing or a friction bond) with bases (385) mated as shown in FIGS. 2A and 2B, the dimensions of the recesses (380*a*) and (380*b*) secures the weight (130) in place. The central weight (130) is preferably made of a high-density metal such as brass or steel.

The equatorial bag (200) has roughly cylindrical symmetry about the bore axis (399) and is constructed of a flexible fabric. (Topologically, the bag (200) is a ring torus, i.e., a hollow toroid.) According to the preferred embodiment, the bag (200) is a crocheted fabric of substantially horizontal rows which form spirals of increasing diameter, with a central axis of (substantially) cylindrical symmetry coincident with the bore axis (399). The majority of the stitches are single crochet stitches, and the increasing diameter of the bag (200) from the equatorial region of the inwards-facing surface (212) to the equatorial region of the outwards-facing surface (210) is produced by including double crochet stitches. The bag (200) is formed by crocheting the top and bottom halves separately and then stitching them together.

The present invention utilizes crochet stitches which are unorthodox in that each stitch only goes through one of the top two threads (as opposed to going through both of the top two threads) of the stitch below. This produces a fabric which is lighter than that which would be produced with a standard crochet stitch. The outwards-facing surface (210) of the bag (200) is, when stuffed, substantially a spherical section, and the contour of the inwards-facing surface (212) of the bag (200) substantially form fits the outer contour of the throughbore pieces (300*a*) and (300*b*) and the central weight (130). An advantage of using a crocheted fabric for the bag (200) is that different colors and designs can be produced with no tooling costs, allowing a wide variety of attractive designs to be produced.

The pellets (250) within the equatorial bag (200) are made of a light-weight material, preferably granulated cork. Using granulated cork provides the advantages that (i) a substantial portion of the volume is air, thereby reducing the average specific gravity and increasing the goodness-of-operation ratio Φ, (ii) granules can slide over each other thereby creating a softer feel to the stuffed bag (200), and (iii) cork is compressible, thereby adding to the softness of the stuffed bag (200). According to the preferred embodiment, the cork granules have diameters between 2 mm and 3 mm. Cork has a specific gravity of roughly 0.2 g/cc, and cork granules have a specific gravity of roughly 0.07 g/cc.

In particular, according to the preferred embodiment the central weight (130) is made of steel and has a height of 0.9 cm, width of 1.94 cm, throughbore width of 1.0 cm, mass $m_w$ of 15.0 g and moment of inertia $I_w$ of 5.5 g*cm$^2$. Two mated vortex pieces (300), which together provide the vortex component, have a density of 1.16 g/cc, height h of 3.3 cm, mass $m_v$ of 4.3 g, and moment of inertia $I_v$ of 7.1 g*cm$^2$. The stuffed equatorial bag (200) has a substantially spherical outer surface with a equatorial diameter of 4.4 cm and height of 3.0 cm, a substantially cylindrical central throughbore section with a diameter of 2.0 cm and height of 2.1 cm which then flairs to the mouths (328) of the throughbore (320), and the crochet material has a thickness of 0.2 cm, weight of 5.8 g, and moment of inertia is 12.6 g*cm$^2$. The cork pellets (250) inside the bag (200) have a mass $m_c$ of 2.0 g and moment of inertia $I_c$ of 3.3. The goodness-of-operation ratio Φ is therefore $[(m_w+m_v+m_b+m_c)\ h^2/(I_w+I_v+I_b+I_c)]^{1/2}=[(15.0+4.3+5.8+2.0)\ 3.3^2/(5.5+7.1+12.6+3.3)]^{1/2}=3.2$. It should be noted that the goodness-of-operation ratio Φ value of 3.2 is a substantial improvement over the value discussed above of 4.1 for the polyurethane foam version of the toy.

Thus, it will be seen that the improvements presented herein are consistent with the objects of the invention for a swinging bob toy described above. While the above description contains many specificities, these should not be construed as limitations on the scope of the invention, but rather as exemplifications of preferred embodiments thereof. Many other variations are within the scope of the present invention. For example: a non-crocheted fabric may be used; the throughbore pieces need not have spokes and hollows; the throughbore may not include concave portions; each bob need not have the same construction; etc. Furthermore, the description of the underlying physical principles are described as presently understood, may include simplifications and approximations, and may not be accurate and are not intended to be limiting. Accordingly, it is intended that the scope of the invention is determined not by the embodiments illustrated or the physical analyses motivating the illustrated embodiments, but rather by the appended claims and their legal equivalents.

What is claimed is:

1. An orbiting bob toy comprising:

a flexible, elongated tethering means;

a first end bob; and a sliding bob having a throughbore component providing a throughbore along a polar axis normal to an equator in an equatorial plane, said throughbore component having a first mouth at a first end thereof and a second mouth at a second end thereof, said tethering means passing through said throughbore of said throughbore component so that said sliding bob is slidable along said tethering means, said first end bob being constrained on said tethering means between said sliding bob and a first end of said tethering means, said sliding bob having a weight encircling a central portion of said throughbore component, said sliding bob having a bag which has cylindrical symmetry about said polar axis, said bag encircling a middle portion of said throughbore component and said weight, said bag being stuffed with pellets, said pellets having a pellet specific gravity, said throughbore component having a throughbore specific gravity, and said weight having a weight specific gravity, where said weight specific gravity is greater than said throughbore specific gravity, and said throughbore specific gravity is greater than said pellet specific gravity.

2. The orbiting bob toy of claim 1 wherein, in cross-section on a plane along said polar axis, an intermediate portion of said throughbore component to each side of said equatorial plane has a concave contour.

3. The orbiting bob toy of claim 2 wherein, in cross-section on a plane along said polar axis, each of said intermediate portions is bordered by a convex inner portion between said each of said intermediate portions and said equatorial plane, and said each of said intermediate portions is bordered by a convex outer portion at a mouth of said throughbore, each of said convex inner portions having a first length, each of said convex outer portions having a second length, and said each of said intermediate portions having a third length greater than said first length and said second length.

4. The orbiting bob toy of claim 2 wherein said each of said intermediate portions of said throughbore component has a plurality of hollows and a plurality of spokes between said hollows, said spokes connecting a central portion of said throughbore component to said first mouth and said second mouth of said throughbore component.

5. The orbiting bob toy of claim 1 wherein said bag is topologically a hollow toroid and said throughbore component is made of a rigid material, said throughbore component is constructed of two throughbore pieces, and said two throughbore pieces are mated in the vicinity of said equatorial plane.

6. The orbiting bob toy of claim 1 further comprising a second end bob, said second end bob being constrained on said tethering means between said sliding bob and a second end of said tethering means, said sliding bob being constrained to said tethering means between said first and second end bobs.

7. The orbiting bob toy of claim 1 wherein said equatorial bag is a crocheted fabric wherein each of a majority of the stitches only goes through one of the top two threads of the stitch below.

8. An orbiting bob toy comprising:

a flexible, elongated tethering means;

a first end bob; and a sliding bob having a throughbore component providing a throughbore along a polar axis normal to an equator in an equatorial plane, said throughbore component having a first mouth at a first end thereof and a second mouth at a second end thereof, said tethering means passing through said throughbore of said throughbore component so that said sliding bob is slidable along said tethering means, said first end bob being constrained on said tethering means between said sliding bob and a first end of said tethering means, said sliding bob having a weight encircling a central portion of said throughbore component, an intermediate portion of said throughbore component to each side of said equatorial plane, in cross-section on a plane along said polar axis, having a concave contour.

9. The orbiting bob toy of claim 8 wherein each said intermediate portion of said throughbore component has a plurality of hollows and a plurality of spokes between said hollows, said spokes connecting said central portion of said throughbore component to said first mouth and said second mouth of said throughbore component.

* * * * *